United States Patent [19]

Mahler

[11] 3,944,494

[45] Mar. 16, 1976

[54] STABILIZATION OF TRICHLORODIFLUORO BENZENES

[75] Inventor: Walter Mahler, Wilmington, Del.

[73] Assignee: E. I. Du Pont de Nemours and Company, Wilmington, Del.

[22] Filed: May 16, 1974

[21] Appl. No.: 470,638

Related U.S. Application Data

[63] Continuation-in-part of Ser. No. 365,273, May 30, 1973, abandoned.

[52] U.S. Cl. ..... 252/68; 60/651; 60/671; 165/1; 165/51; 165/134; 252/67

[51] Int. Cl.[2] ..... F28F 19/00; C09K 5/04

[58] Field of Search ..... 365/273; 252/67, 68; 60/651, 671; 165/1, 51, 134

[56] References Cited

UNITED STATES PATENTS

| | | | |
|---|---|---|---|
| 2,824,061 | 2/1958 | Davidson et al. | 252/68 |
| 3,774,393 | 11/1973 | Bechtold et al. | 252/67 |
| 3,834,166 | 9/1974 | Cupper et al. | 60/651 |

*Primary Examiner*—Mayer Weinblatt
*Assistant Examiner*—John D. Smith

[57] ABSTRACT

Trichlorodifluorobenzene is thermally stabilized particularly in the presence of engineering metals by contacting it, especially when at temperatures greater than about 200°C, with solid alkaline earth carbonates or with alkali or alkaline earth borates in a sufficient amount. The method is particularly useful in Rankine-cycle engines using trichlorodifluorobenzene as the working fluid, when the stabilizer is contained in the boiler.

7 Claims, No Drawings

STABILIZATION OF TRICHLORODIFLUORO BENZENES

RELATED APPLICATION

This application is a continuation-in-part of Ser. No. 365,273 filed May 30, 1973, and now abandoned.

BACKGROUND OF THE INVENTION

1. Field of the Invention

This invention relates to a method of thermally stabilizing trichlorodifluorobenzene particularly in the presence of engineering metals.

2. The Prior Art

The use of trichlorodifluorobenzenes as a power fluid in a rotary Rankine-cycle engine has been disclosed in Bechtold and Tullock U.S. Pat. No. 3,774,393.

While the trichlorodifluorobenzenes have excellent thermal stability in their own right, there is need for further improvement to prolong their use in this and other heat transfer applications and to prevent the formation of undesirable biphenyl type products on decomposition, and also of gaseous by-products.

DESCRIPTION OF THE INVENTION

The present invention is an improved method of heat transfer wherein a trichlorodifluorobenzene fluid is circulated in a temperature gradient including temperatures above about 200°C and wherein said fluid is contacted with a thermally stabilizing amount of an acid accepting solid selected from alkaline earth carbonates and alkali and alkaline earth borates and phosphates.

It is contemplated that the heat transfer methods of this invention will be particularly useful in dense vapor turbines where the thermodynamic advantages of trichlorodifluorobenzene can be extended to higher temperatures and longer operating times because of the better thermal stability and lower corrosivity afforded by the stabilizers. The useful temperature range for this application is generally between the normal boiling point and the critical temperature of the fluid. An especially useful embodiment of the method utilizes liquid trichlorodifluorobenzene at temperatures from about 300° to about 400°C in a rotary engine such as described in the U.S. Pat. No. 3,613,368 issued to William A. Doerner and commonly assigned. It will also be understood that trichlorodifluorobenzene used in the manner taught by this invention can be advantageously applied in other heat exchange processes not involving vapor impulsion, and generally operating at lower temperatures. It will be appreciated that problems of thermal stability and corrosivity to metals are more pronounced at higher temperatures. While the advantages of this method become more quickly apparent at higher temperatures, the alternative economic advantage of extended operability at lower temperatures can be readily inferred and is none the less important.

While the individual isomers of trichlorodifluorobenzene are useful fluids in the practice of this invention, economic advantages will generally recommend the use of isomer mixtures. Among the six position isomers of $C_6HCl_3F_2$ there is little difference in boiling point, about 203°C, and critical temperature around 430°C. The smallest liquid range (mp 50°) is shown by 2,3,4-trichloro-1,5-difluorobenzene; the largest by 1,2,5-trichloro-3,4-difluorobenzene (mp −25°C) which isomer also shows especially good thermal stability. The particular mix of isomers usually available will be determined by the synthesis procedure used. A convenient method of preparation is by heating pentachlorobenzene with potassium fluoride in sulfolane (tetramethylene sulfone) as described in U.S. Pat. No. 3,774,393. This process typically yields a mixture comprising 12.2% 1,3,5-trichloro-2,4-difluorobenzene
58.2% 1,2,4-trichloro-3,5-difluorobenzene
6.3% 1,2,3-trichloro-4,5-difluorobenzene
15.6% 1,2,5-trichloro-3,4-difluorobenzene
6.8% 2,3,4-trichloro-1,5-difluorobenzene
0.9% 1,3,4-trichloro-2,5-difluorobenzene This mixture has a melting point of about −40°C, a boiling point of about 203°C and a critical temperature of 427°C. Mixtures of other isomeric proportions will also benefit from the stabilizing methods disclosed herein, as will mixtures of trichlorodifluorobenzene with other halobenzene fluids.

The solid stabilizers for use with trichloro-difluorobenzene are generally recognized as acid acceptors and may function by a mechanism related to the removal of catalytic acid species which are intermediates in the thermal decomposition or in the corrosive attack on metals. Generally both the thermal decomposition of the fluid to form the undesirable polychlorinated biphenyls and its corrosivity to metals are simultaneously reduced by the action of the stabilizers. However, not all alkaline substances are effective. Certain strongly alkaline substances such as $Na_2CO_3$ and CaO may actually promote the decomposition of the chlorofluorobenzenes in contrast to their stabilizing effect on the chlorobenzenes as disclosed in my concurrently filed patent application Ser. No. 470,636.

By alkali metal is meant all the metals of periodic group IA of atomic number 3 to 55. By alkaline earth metal is meant magnesium as well as calcium, strontium, and barium, but the term as used herein does not include the metal beryllium which is regarded as an exceptional metal of periodic group IIA.

The term "phosphates" includes condensed phosphates and polyphosphates as well as the simple phosphates, $Na_3PO_4$, $Na_2HPO_4$ and $NaH_2PO_4$.

The solid inorganic stabilizers of this invention should preferably contact the liquid phase of the heat transfer fluid to be most effective. It is believed that thermal decomposition and corrosive attack upon metals under heat transfer conditions occurs primarily in the liquid phase or at the liquid-vapor interface rather than in the saturated vapor. However, the stabilizers of the present invention are also effective with vapor. The stabilizers may be used as powders or pellets distributed throughout the liquid volume or they may be confined to a separate region through which the liquid or vapor flows. Alternatively the stabilizing compositions may be present as a coating on the metal surface. Such a coating provides intimate contact at an effective site, but it may also reduce the efficiency of heat transfer. Still another method of stabilizer disposition is to form the solid, with binders if necessary, into a shaped article such as an open grid which can then be fired to form a self-supporting shape appropriate to the configuration of the heat transfer system. The optimum distribution of the stabilizer can readily be determined for any of the wide range of heat transfer configurations in which fluids are used.

The amount of stabilizer needed to provide adequate protection against thermal decomposition can be quite small and will in general depend upon its distribution and on the use conditions. A significant improvement in stability can be measured whenever the bulk temperature of the liquid is at least about 260°C. Amounts of the order of 5 percent by weight of the heat transfer fluid are usually adequate even at liquid temperatures as high as 400°C. For less severe use conditions amounts as small as one percent or less are useful for improving thermal stability.

The stabilization is effective when the liquid is contained in most materials of construction applicable for heat exchange surfaces. Steels, including high-temperature, high-strength alloys such as high chromium steels can be used, as well as the more economical plain carbon steel which is servicable at lower temperatures and stresses. Stabilization is also effected in the presence of aluminum or nickel or their alloys. Even in inert vessels such as glass, the high temperature utility of trichlorodifluorobenzene is increased by a reduction in the rate of formation of polychlorinated biphenyls which constitute a toxic hazard of long persistence.

This invention is further illustrated by the following examples, which should not, however, be construed as fully delineating the scope of this discovery.

EXAMPLES

In the following examples the thermal stability of trichlorodifluorobenzene was determined by sealing the liquid isomeric mixture obtained from pentachlorobenzene-KF synthesis in about one gram quantities into small Pyrex-glass tubes with small amounts (usually 0.05g) of the stabilizing solid. A small metal coupon usually about 2–3 $cm^2$ completely immersed in the liquid was used to test corrosive attack. The sealed tubes along with controls containing unstabilized liquid were kept for the indicated time at a temperature of 350° or 400°C. After cooling and opening the tubes the weight loss by corrosion was measured after washing, lightly rubbing with a paper towel to remove any superficial coating and drying. The extent of thermal decomposition of the liquid was indicated by measuring the amount of biphenyls in the liquid by standard vapor phase chromatographic techniques.

Example 1

A 1.0g sample of a mixture of $C_6HCl_3F_2$ isomers was kept in contact with a coupon of type 430 stainless steel at 350°C for 100 days. At the end of that time corrosion of the stainless steel amounted to 3.3mg metal lost per $cm^2$ of metal surface. Biphenyl formation amounted to 1.3%. The same experiment was carried out but with 0.05g $Na_2B_4O_7$ present. Now corrosion was measured as 0.00mg per $cm^2$ and biphenyl formation amounted to 0.13%.

Example 2

The conditions of example 1 were repeated (350° for 100 days), but the test metal was type P-11 steel (1.3% Cr, 0.5% Mo). This showed a corrosion of 5.8mg per $cm^2$ and biphenyl formation of 1.3%. Repeating the experiment with 0.05g $Na_2B_4O_7$ present gave a corrosion of 0.83mg per $cm^2$ and biphenyl formation of 0.37%.

Example 3

A 1.0g sample of a mixture of $C_6HCL_3F_2$ isomers was placed in contact with a coupon of nickel and kept at 400° for 7 days. The metal showed a weight loss corresponding to 1.0mg per $cm^2$ and biphenyl formation of 0.54%. The experiment was repeated except that 0.05g $CaCO_3$ was added. Now the weight loss was 0.00mg per $cm^2$ and biphenyl formation 0.39%.

Example 4

Under the conditions of Example 3, a sample of Inconel X-750 (70% Ni, 16% Cr, 2.5% Ti, 11.5% Fe) had a weight loss of 1.0mg per $cm^2$ and biphenyl formation of 3.4% in the absence of additive. With 0.05g of $CaCO_3$ the weight loss was 0.06mg per $cm^2$ and biphenyl formation was 2.4%.

Example 5

Under the conditions of Example 3, type 1018 steel had a weight loss of 6.2mg per $cm^2$ and biphenyl formation of 6.5%. With 0.05g of $CaCO_3$ the weight loss was 4.4mg per $cm^2$ and biphenyl formation 3.4%.

Example 6

Under the conditions of Example 3, a sample of type P-11 steel had a weight loss of 6.7mg per $cm^2$ and biphenyl formation was 4.4% without additive. With 0.05g $Na_5P_3O_{10}$ the weight loss was 5.8mg per $cm^2$ and the biphenyl formation was 2.7%. In the presence of 0.01g $Na_2B_4O_7$ the weight loss was 4.8mg per $cm^2$ and biphenyl formation was 3.7%. With 0.05g $Na_2B_4O_7$ comparable results were 2.8mg per $cm^2$ and 3.8% biphenyl.

Example 7

A 1.0g sample of $C_6HCl_3F_2$ isomers was placed in contact with type P-11 steel at 400° for 28 days. Weight loss amounted to 11.8mg per $cm^2$ and biphenyl formation was 22%. In the presence of 0.05g $Na_2B_4O_7$ the weight loss was 11.8mg per $cm^2$ and biphenyl formation was 8.3%. In the presence of 0.05g $CaCO_3$ weight loss was 9.5mg per $cm^2$ and biphenyl formation was 7.9%.

When the tests were completed after 28 days the sample tubes were opened within a sealed system so that any gas developed during the test could be measured. The unstabilized liquid as a result of decomposition generated 7.6 cc (STP) of hydrogen gas, while no measurable gas was found in the sample tubes stabilized with $Na_2B_4O_7$ or $CaCO_3$. Reduced hydrogen evolution is particularly important for fluids used in a Rankine cycle engine since the non-condensable gas otherwise tends to blanket the tube area and reduce condenser capacity.

Example 8

A 1.0g sample of $C_6HCl_3F_2$ isomer mixture in a sealed glass tube at 400° for 7 days in the absence of metal was 2.0% converted to biphenyls. In the presence of 0.05g of $Na_5P_3O_{10}$ the conversion to biphenyl was 0.51%. In the presence of $Na_2B_4O_7$ biphenyl formation was 0.79%; with $Na_2P_6O_{13}$ 0.72%, with $Li_3PO_4$ 1.1% and with $CaCO_3$ 0.052%.

Example 9

Portions of a $C_6HCl_3F_2$ isomer mixture 0.3 cc each were sealed into each of three Pyrex-glass tubes containing aluminum coupons weighing about 0.2g. One tube contained 0.05g CaO; another contained 0.05g $CaCO_3$; the other a control, contained no additional solid. The tubes were sealed and kept at 400°C. By the fourteenth day the Al coupon was coated in the control tube. The aluminum in the tube with $CaCO_3$ was still very clean. The tube containing CaO was completely black with no liquid any longer visible. After 28 days the control tube was quite black with a heavy coating on the coupon, while the tube containing $CaCO_3$ appeared to be unchanged. When the tubes were opened and the liquids analysed the control tube contained 0.42% biphenyls while the tube containing $CaCO_3$ had only 0.11% biphenyls.

Example 10

A 3 g sample of $C_6HCl_3F_2$ was placed in a tube of 80 cc volume together with two coupons of 26-1 stainless steel having a total surface 6.8 $cm^2$ and weight of 3.9605 g. The air was evacuated from the tube and sealed. Another 80 cc tube was loaded with 3 g of $C_6HCl_3F_2$, two coupons of 26-1 stainless steel (6.8 $cm^2$, 3.7406 g), and 0.1 g of $Na_2B_4O_7$, evacuated and sealed. Both of the tubes were heated at 432°C for 7 days. Under these conditions, the $C_6HCl_3F_2$ is completely in the gas phase at 10 atmospheres pressure. At the end of this time, the metal coupons were washed in water and acetone. The coupons that were in the presence of $Na_2B_4O_7$ showed a weight gain of 0.1 mg whereas the coupons that had no additive showed a weight loss of 5.1 mg. The biphenyl analysis showed a decomposition of 0.22% for the sample with $Na_2B_4O_7$ while the control showed 0.41% decomposition.

Since obvious modifications and equivalents in the invention will be evident to those skilled in the art, I propose to be bound solely by the appended claims.

The embodiments of the invention in which an exclusive property or privilege is claimed are defined as follows:

1. In a method of heat transfer wherein trichlorodifluorobenzenes are cycled through a thermal gradient including temperatures above about 200°C, the improvement which comprises contacting said trichlorodifluorobenzenes with a thermally stabilizing amount of a solid acid acceptor selected from the group consisting of alkali metal borates, alkali metal phosphates, alkaline earth metal carbonates, alkaline earth metal borates and alkaline earth metal phosphates.

2. The method of claim 1 in which the trichlorodifluorobenzenes are in contact with steel, aluminum- or nickel-base alloys.

3. The method of claim 2 wherein the trichlorodifluorobenzenes are contacted with said acid acceptor at a temperature between 300°C and 430°C.

4. The method of claim 3 wherein said acid acceptor is sodium borate.

5. The method of claim 3 wherein said acid acceptor is calcium carbonate.

6. The method of claim 3 wherein said acid acceptor is $Na_5P_3O_{10}$.

7. The method of claim 3 wherein said acid acceptor is $Na_6P_6O_{13}$.

* * * * *

UNITED STATES PATENT OFFICE

CERTIFICATE OF CORRECTION

PATENT NO. : 3,944,494

DATED : March 16, 1976

INVENTOR(S) : Walter Mahler

It is certified that error appears in the above-identified patent and that said Letters Patent are hereby corrected as shown below:

Column 6, line 28, the compound "$Na_6P_6O_{13}$" should be --$Na_2P_6O_{13}$--.

Signed and Sealed this

Seventeenth Day of May 1977

[SEAL]

*Attest:*

RUTH C. MASON
*Attesting Officer*

C. MARSHALL DANN
*Commissioner of Patents and Trademarks*